US010882709B2

(12) United States Patent
Lupi et al.

(10) Patent No.: US 10,882,709 B2
(45) Date of Patent: Jan. 5, 2021

(54) REWINDING MACHINE

(71) Applicant: UNITED CONVERTING S.R.L., Lucca (IT)

(72) Inventors: Giuseppe Lupi, Lucca (IT); Angelo Torri, Lucca (IT); Gianluca Giometti, Parezzana (IT)

(73) Assignee: UNITED CONVERTING S.R.L., Lucca (IT)

( * ) Notice: Subject to any disclaimer, the term of this patent is extended or adjusted under 35 U.S.C. 154(b) by 54 days.

(21) Appl. No.: 16/327,544

(22) PCT Filed: Aug. 1, 2017

(86) PCT No.: PCT/IB2017/000892
§ 371 (c)(1),
(2) Date: Feb. 22, 2019

(87) PCT Pub. No.: WO2018/037272
PCT Pub. Date: Mar. 1, 2018

(65) Prior Publication Data

US 2019/0185282 A1 Jun. 20, 2019

(30) Foreign Application Priority Data

Aug. 25, 2016 (IT) ..... 102016000087356

(51) Int. Cl.
*B65H 18/14* (2006.01)
*B65H 19/22* (2006.01)
(Continued)

(52) U.S. Cl.
CPC ..... *B65H 18/145* (2013.01); *B65H 18/025* (2013.01); *B65H 19/2246* (2013.01);
(Continued)

(58) Field of Classification Search
CPC ..... B65H 18/145; B65H 19/267; B65H 19/2269; B65H 19/2246; B65H 2408/235
See application file for complete search history.

(56) References Cited

U.S. PATENT DOCUMENTS 5,954,291 A 9/1999 Meinecke et al.
2008/0271869 A1* 11/2008 Tsai ..... B65H 19/2269 162/283

(Continued)

FOREIGN PATENT DOCUMENTS

DE 36 40 366 A1 6/1988
EP 1 375 401 A1 1/2004

(Continued)

*Primary Examiner* — Sang K Kim
(74) *Attorney, Agent, or Firm* — McGlew and Tuttle, P.C.

(57) ABSTRACT

Rewinding machine comprising a drive unit (1) for supplying a paper veil (2); a winding unit (3) for winding the paper veil supplied by the drive unit into a coil (W) around a winding core (4), comprising a primary roller (6) and a secondary roller (7) rotating in contact with the winding core (4), and a pressure unit (30) provided with a rotating roller (A, B, C) on the coil (W) that is being formed; a core exchange unit (5) for ejecting the formed coil (W) from the machine at the end of a winding cycle and inserting a new core to be wound; separation means (11) for interrupting the continuity of the paper veil at the end of a winding cycle; means for winding a drawing flap (34) of the veil (2) on the new core (4) at the beginning of a new winding cycle.

9 Claims, 8 Drawing Sheets

Figure 1:
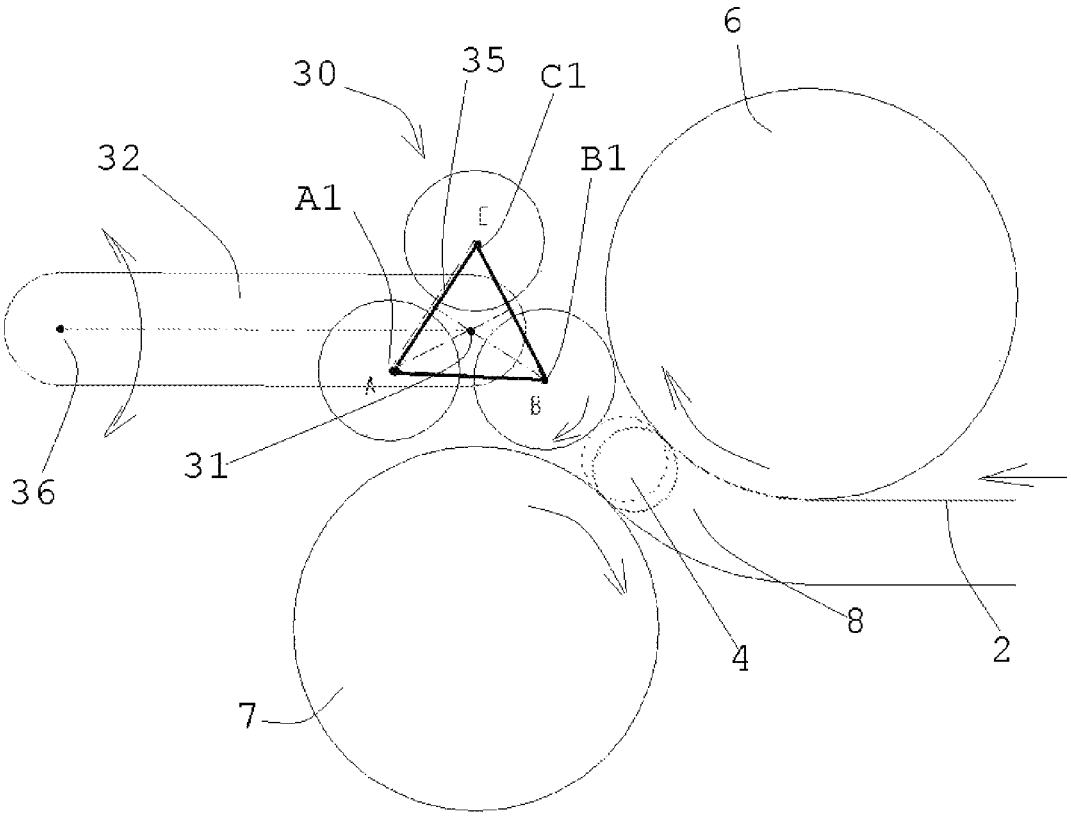

(51) Int. Cl.
*B65H 19/26* (2006.01)
*B65H 18/02* (2006.01)

(52) U.S. Cl.
CPC ..... *B65H 19/2269* (2013.01); *B65H 19/267* (2013.01); *B65H 2301/41376* (2013.01); *B65H 2404/142* (2013.01); *B65H 2404/152* (2013.01); *B65H 2404/432* (2013.01); *B65H 2408/235* (2013.01); *B65H 2515/50* (2013.01); *B65H 2701/1924* (2013.01)

(56) References Cited

U.S. PATENT DOCUMENTS

| | | | | |
|---|---|---|---|---|
| 2012/0085856 | A1 | 4/2012 | Lupi et al. | |
| 2013/0221150 | A1* | 8/2013 | Morelli ..... | B65H 19/26 242/522 |
| 2015/0129708 | A1 | 5/2015 | Lupi et al. | |
| 2017/0210584 | A1* | 7/2017 | Morelli ..... | B65H 18/20 |

FOREIGN PATENT DOCUMENTS

| | | | |
|---|---|---|---|
| IT | FI2009A000125 | A1 | 12/2010 |
| IT | 1412632 | A1 | 1/2014 |
| WO | 2011/114361 | A1 | 9/2011 |
| WO | 2012/085953 | A1 | 6/2012 |

* cited by examiner

REWINDING MACHINE

TECHNICAL FIELD OF THE INVENTION

The invention relates to a rewinding machine of the type used in the converting sector to unroll tissue paper veils from a source coil and wind them around sticks or logs intended for future processing for the production of paper rolls for household use.

STATE OF THE ART

It is known that many different types of rewinding machine exist on the market, and they are mostly based on stapling devices that, during the unrolling of the paper, after the rolling up of a new completed log, stop the veil and allow it to be torn off, thus allowing the unloading of the wound log and the loading of a new core to be wound.

As a rule, the rewinding machines include a drive unit of the veil to be wound and, downstream according to the direction of advancement of the veil, a motorized winding unit for winding the paper veil supplied by the drive unit around a tubular winding core in order to form a paper coil or log having the intended size.

Winding units of the known type include a primary roller and a secondary roller, rotating in contact with the winding core, and a pressure unit equipped with a pressure roller, known as presser, rotating when in contact with the log that is being formed and which can move away from the primary and secondary rollers, for example by being supported by rotating arms.

A machine of such type is known from the patent application FI2009A000125 on behalf of the same applicant, in which the interruption of the continuity of the veil is obtained by means of a speed difference between the veil winding unit and drive unit.

A further rewinding machine is known thanks to IT1412632 on behalf of the same applicant, in which pneumatic means are provided to interrupt the continuity of the paper veil at the end of a winding cycle, and to start a new winding cycle.

However, all known systems have some limitations as for vibrations due to the contact of the presser with the coil that is being formed, which in turn makes the entire winding unit unstable and thus limits the maximum possible winding speed.

OBJECT OF THE INVENTION

The present invention is intended to provide a rewinding machine free from the drawbacks of the known art, and which reduces the vibration of the winding unit and thus increases the maximum winding speed.

A further object is to provide a winding unit compatible with both mechanical and pneumatic systems used to interrupt the continuity of the veil.

SUMMARY OF THE INVENTION

These objects have been achieved by developing a rewinding machine according to at least one of the appended claims.

One first advantage is that the winding cycle of the coil, or log, can proceed at an increased paper speed if compared to the known systems, while maintaining the quality of the finished product.

LIST OF DRAWINGS

Figure 13:
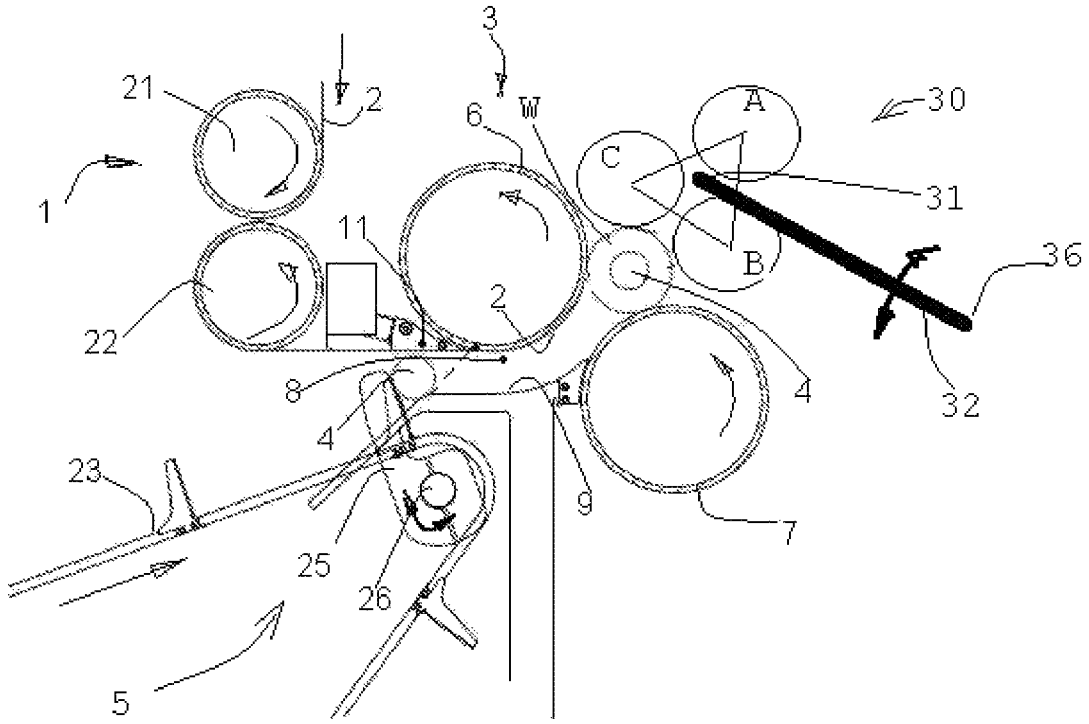

These and other advantages will be better understood by anyone skilled in the art thanks to the following specification and the accompanying drawings, given as a non-limiting example, wherein:

FIG. 1-12*a* schematically show a detail of the pressure unit of the invented machine, in successive configurations from the insertion phase of a core to be wound to the ejection phase of the formed coil and subsequent loading of a new core;

FIG. 13 schematically shows a rewinding machine according to the invention.

Figure 14:
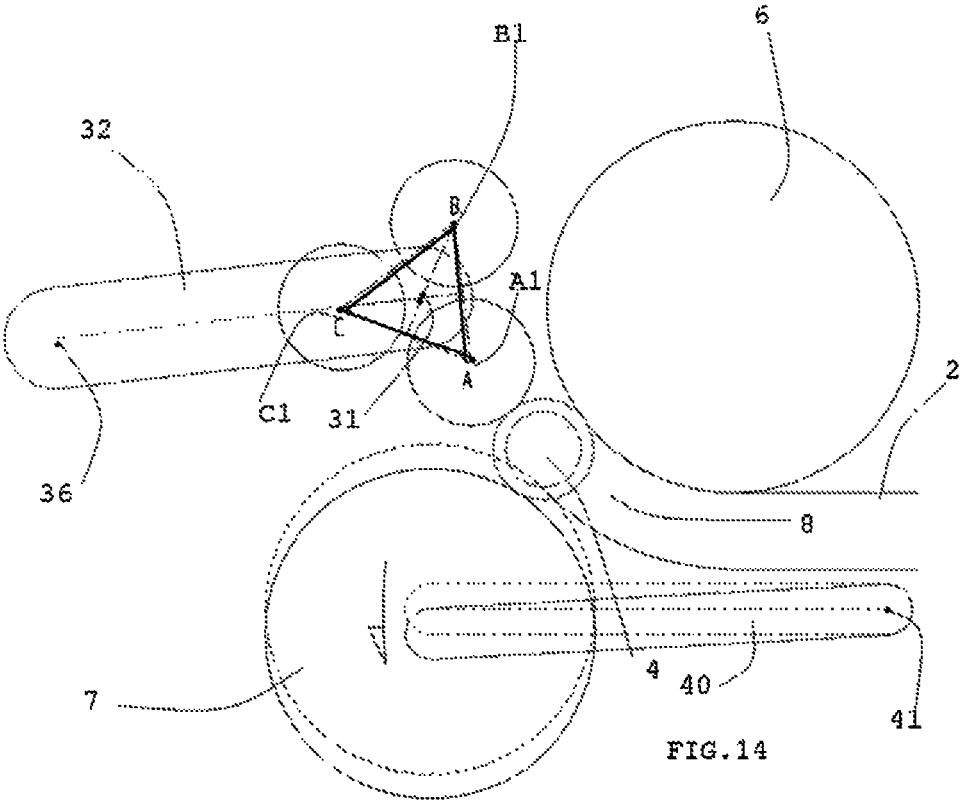

FIG. 14 schematically shows a further embodiment of a rewinding machine according to the invention.

DETAILED DESCRIPTION

With reference to the accompanying drawings and in particular to the diagram of FIG. 13, it is described a preferred embodiment of a rewinding machine according to the invention.

In the described example, the machine comprises a drive unit 1 for supplying a paper veil 2, such unit is preferably provided with a pair of counter-rotating rollers 21, 22 in contact with the veil 2, at a peripheral speed V0 corresponding to a set advancement rate of the veil.

Downstream of the drive unit 1, in the direction of the advancement of the veil 2, a winding unit 3 is provided and intended for winding the paper veil around a winding core 4 as a coil W.

Preferably, the winding unit 3 comprises a rotating primary roller 6 and secondary roller 7, in contact with the core 4 that is being wound so as to form a winding channel 8 in cooperation with a lower winding slide 9.

In order to perform the winding cycles of the subsequent cores 4, the machine is provided with a core exchange unit 5 to eject from the machine a formed coil W at the end of a winding cycle and insert a new core to be wound.

Preferably, the core exchange unit 5 comprises a lift 23, which moves the core 4—that must be wound—closer to the channel 8 and a pusher element 25, for example of the crank type rotating around a pin 26.

Figure 8:
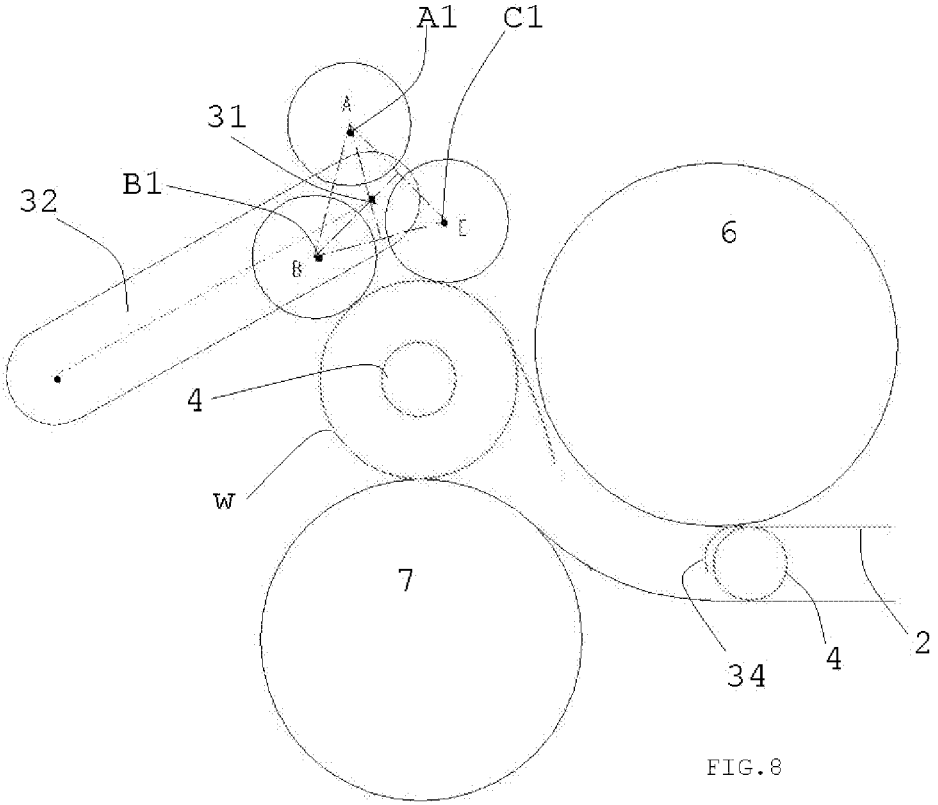

Moreover, in order to perform the core exchange, i.e. the replacement in the machine of a core that has already been wound with a new core ready to be wound, there are means provided for interrupting the continuity of the paper veil at the end of a winding cycle, and for winding a drawing flap 34 of the veil 2 on to the new core 4 at the beginning of a new winding cycle (FIG. 8).

In the described example, the interruption means operate upstream of the inlet of the new core 4 in the channel 8 and comprise a pressurized air dispenser 11 able to send a pressurized jet of air onto the paper veil that is strong enough to cause the paper to be torn off, possibly in the presence of perforations aimed at weakening the veil itself.

In order to facilitate the tearing off of the veil, the machine may further comprise veil stapling means upstream of the channel 8, which retain the veil during the blowing of the air jet or blade onto the veil.

In various embodiments, the veil separation means may comprise already known means able to locally change the advancement speed of the veil 2 at the end of each winding phase and determine the tearing off of the veil itself.

After the veil has been torn off, the continuity of the veil 2 is interrupted and the wound coil is ejected, for example by means of a slide, while the drawing flap 34 of the veil supplied by the drive unit 1 must be wound around the new core 4 to start a new winding cycle.

To this end, there are means provided to roll up the drawing flap of the veil that may include the spreading of glue on the surface of the new core to be wound.

In this case, the veil flap is drawn thanks to the contact between the surface of the core 4 and the drawing flap 34.

According to the invention, the machine comprises a pressure unit 30 preferably positioned downstream of the winding unit 3 in the direction of the advancement of the veil 2 and equipped with at least two motorized pressure rollers A, B, C, which can simultaneously rotate in contact with the coil that is being formed, at least during a part of the winding phase, e.g. the terminal part, both having a peripheral speed that is substantially equal to the set winding speed of the veil 2.

Advantageously, thanks to this solution the contact between the pressure rollers and the winding coil is stable and less subject to vibration phenomena if compared to the systems using a single pressure roller.

In the preferred example of the illustrated embodiment, the pressure unit 30 comprises three pressure rollers A, B, C with respective rotation axes A1, B1, C1 integral through the connecting means 35 with a common rotation axis 31, preferably a common rotation axis having an independent engine with respect to the rotation axes A1, B1, C1 of the pressure rollers A, B, C, which are preferably moved by a single engine, and said axis is supported by a movable arm 32, for example an arm oscillating around an axis 36, which is in turn powered by a third independent engine.

With reference to FIG. 1-12, an example of operation of the invented machine is described, and the behaviour of the pressure unit 30 is highlighted.

FIG. 1: a core 4 has been inserted into the winding channel 8 and is in contact with the primary and secondary rollers 6, 6 of the winding unit and a first roller B of the pressure unit.

Figure 2:
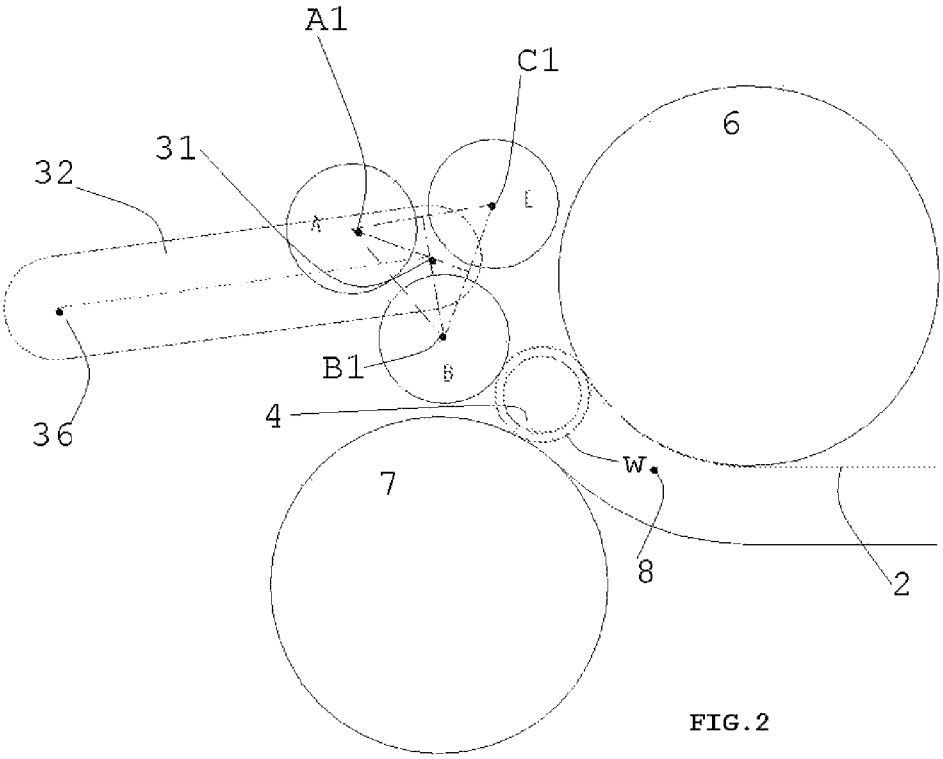

FIG. 2: the coil w is being formed, and the pressure roller B operates in line with the forming of the coil by rotating the oscillating arm 32 around the axis 36.

Figure 3:
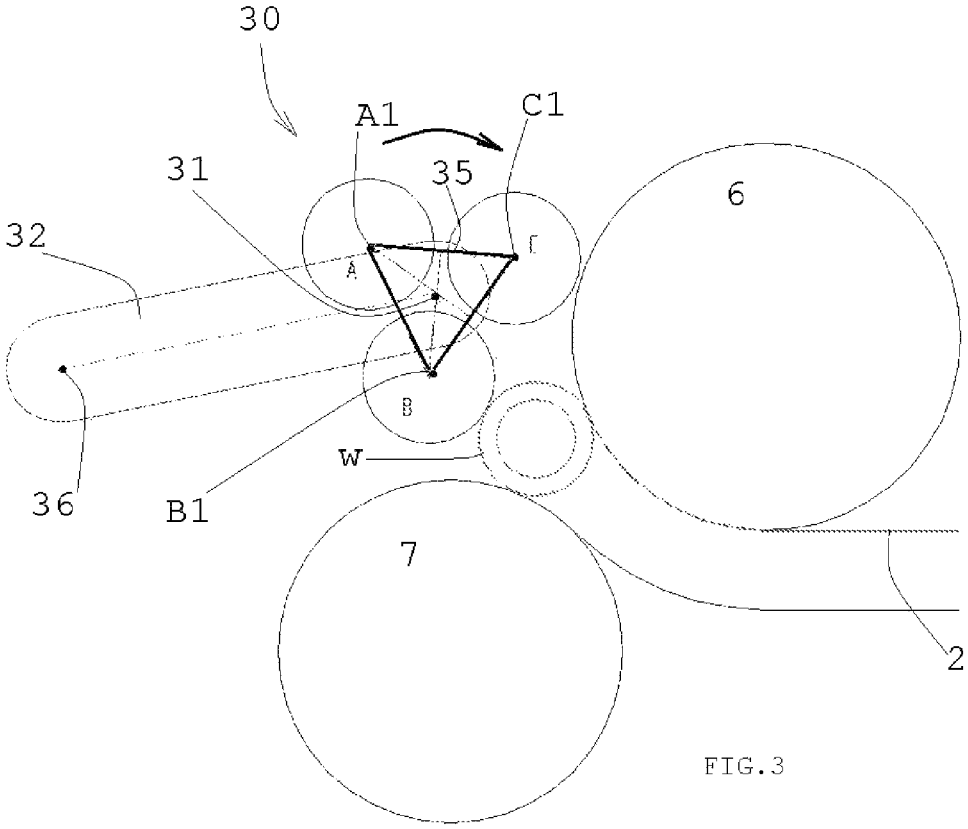
Figure 4:
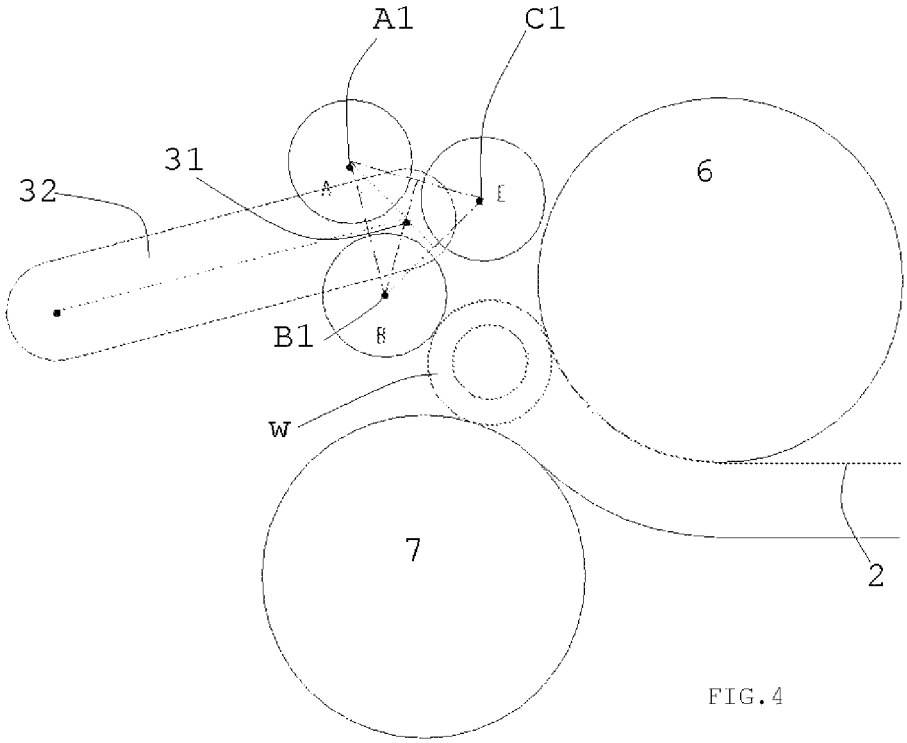

FIG. 3-4: the coil w is thickening, the unit composed of the rollers A, B, C, connected by the constraint means 35, starts rotating (clockwise in the figure) around the common axis 31.

Figure 5:
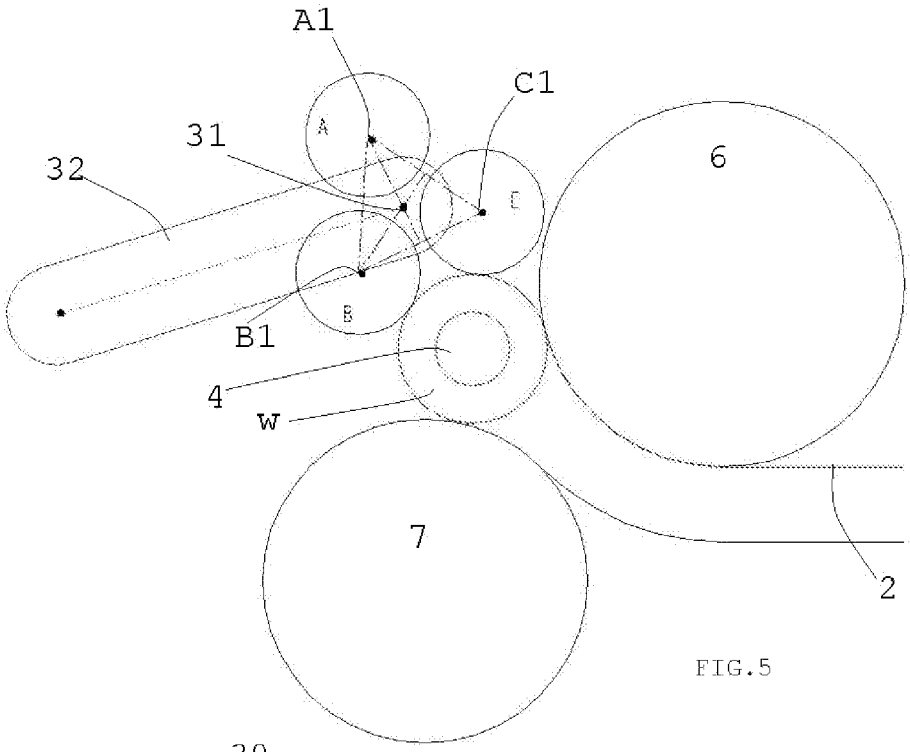

FIG. 5: the unit composed of the rollers A, B, C is rotated and a second roller C of the unit is now in contact with the coil w that is being formed.

Figure 6:
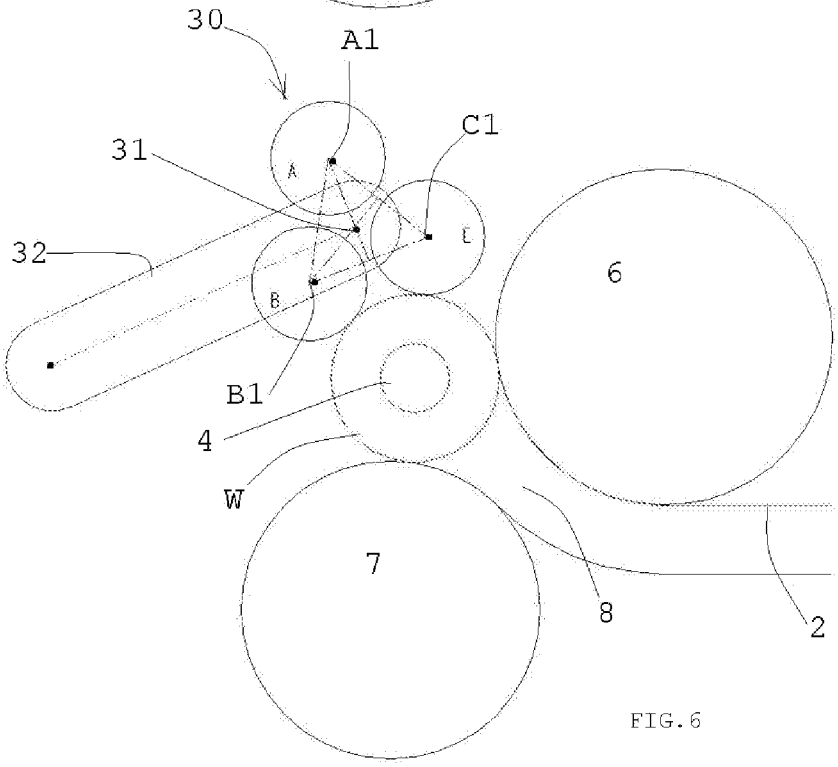
Figure 7:
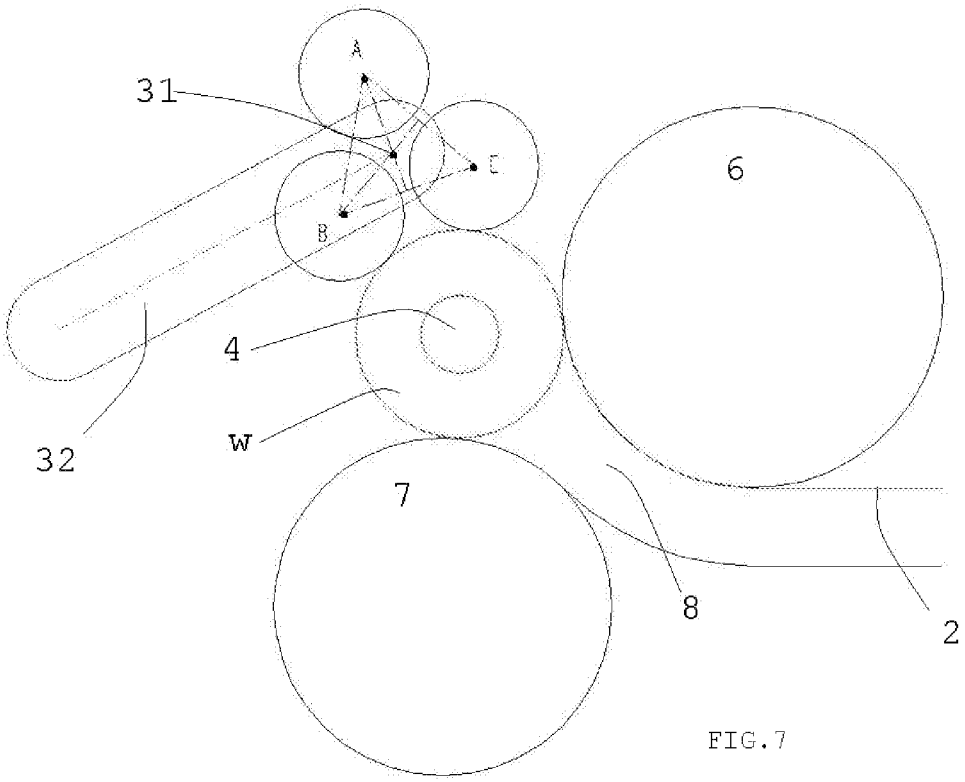

FIG. 6-7: terminal part of the winding phase, during which the coil is thickening and the two rollers B, C are simultaneously in contact with it.

FIG. 8: end of the winding phase, the interruption means caused the separation of the veil 2, the unit composed of the rollers A, B, C, continues to rotate and the two rollers B, C are still in contact with the coil.

In the described example, the interruption phase is performed by means of the pneumatic dispenser 11. However, by means of the machine according to the invention, it is advantageously possible to perform the interruption phase of the continuity of the veil 2 by imposing an acceleration of the unit composed of the rollers A, B, C around the rotation axis 31. As a matter of fact, in such a case, due to the acceleration of the roller unit, the peripheral speed of the veil on the coil W at the contact point with the rollers B, C is determined by the peripheral speed of the rollers B, C, equal to the set advancement speed V0 of the veil, added to the peripheral rotation speed Vp of the unit composed of the rollers A, B, C. The increasing of the local speed of the veil, which has already been wound on the coil with respect to the set advancement speed, causes tension in the upstream veil portion, therefore the veil is torn off and interrupted.

Figure 9:
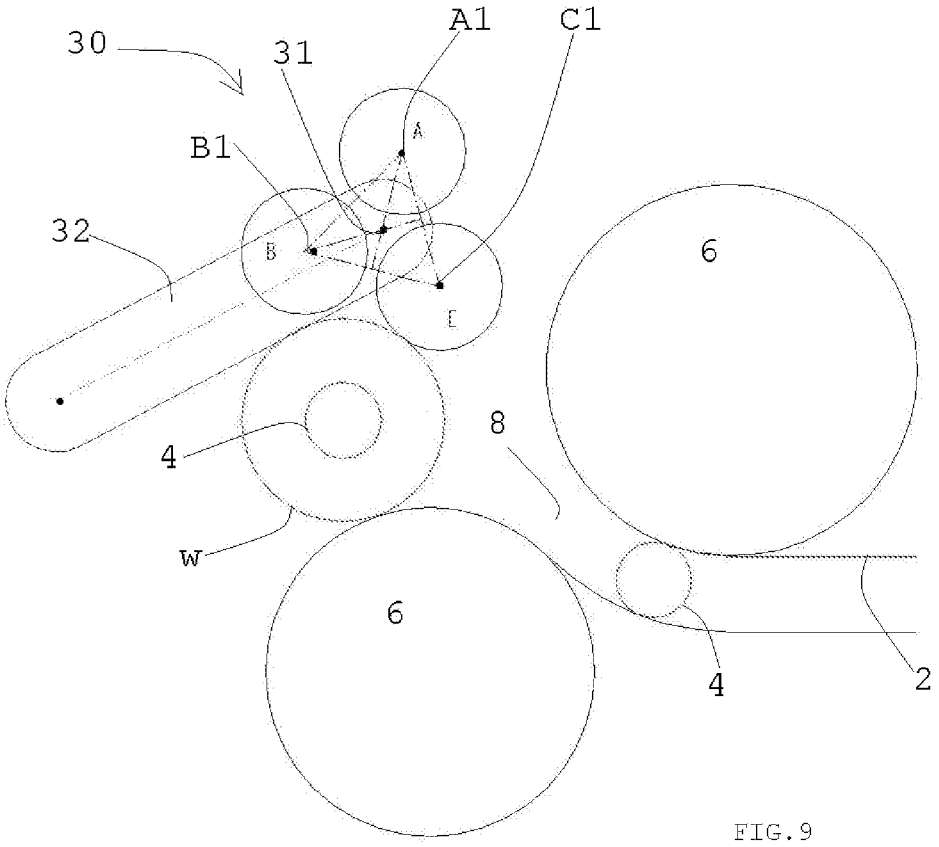

FIG. 9: ejection phase of the formed coil W and insertion into the channel 8 of the new core 4, the unit composed of the rollers A, B, C keeps rotating.

Figure 10:
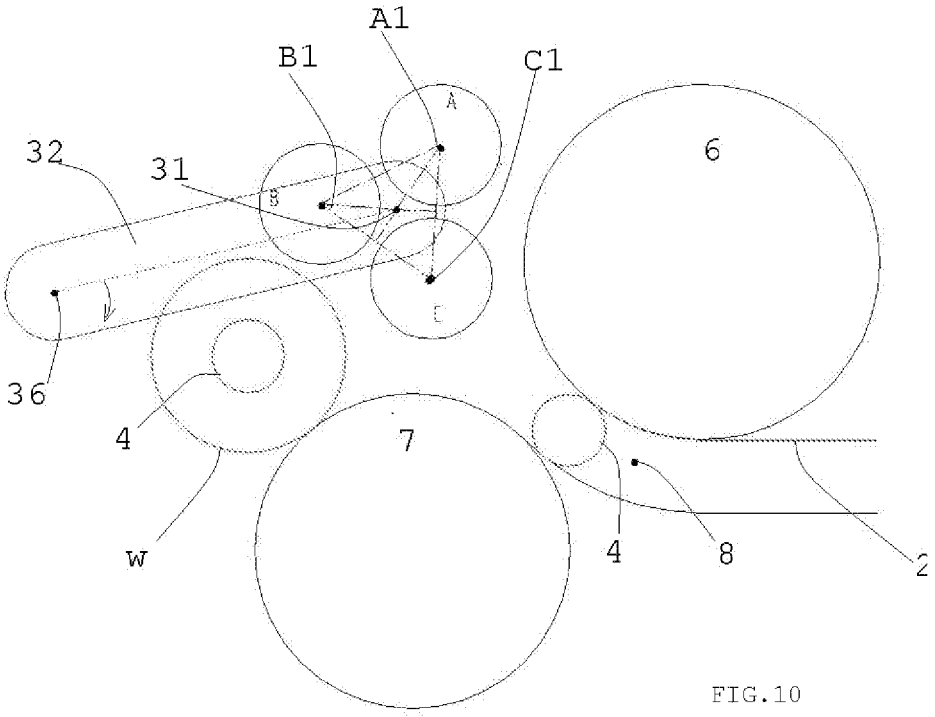
Figure 11:
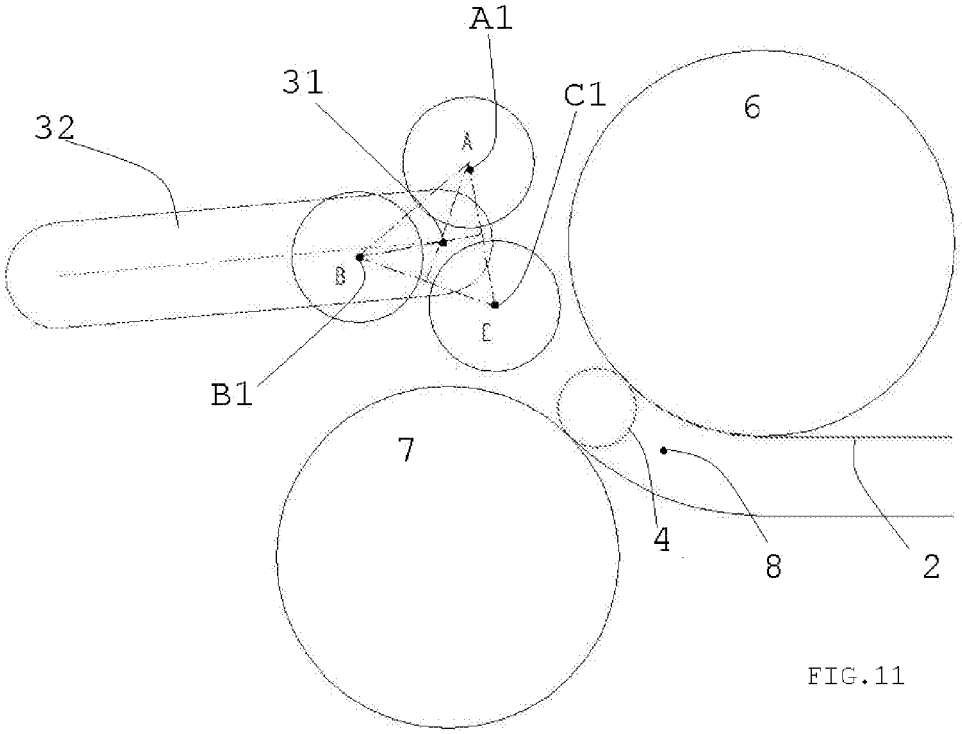
Figure 12:
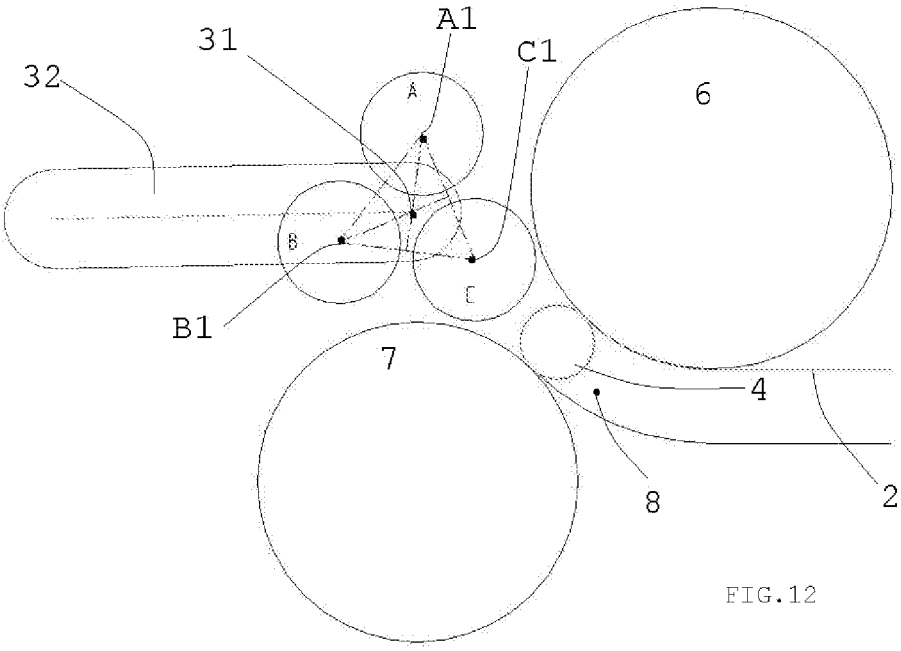
Figure 12A:
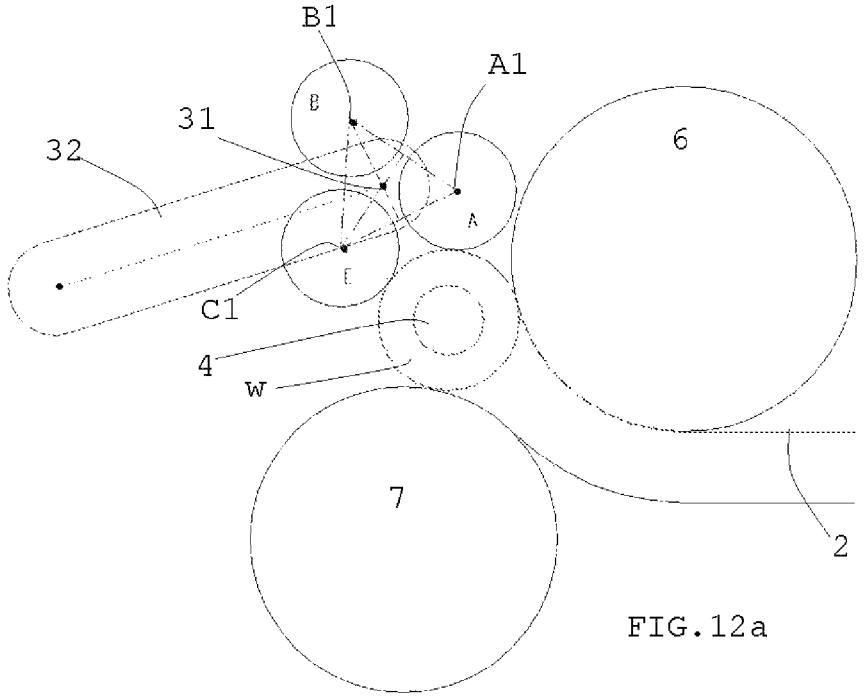

FIG. 10-12, the formed coil w has been ejected, the oscillating arm 32 rotates around the axis 36 approaching the new coil 4, the unit composed of the rollers A, B, C keeps rotating and the second roller C approaches the new core 4.

FIG. 5: coil w is in a new winding phase, corresponding to the phase described in FIG. 5. The unit composed of the rollers A, B, C is rotated, the second roller C and the third roller A of the unit are alternated according to their position to the first roller B and the second roller C respectively, and are now in contact with the new coil W that is being formed.

FIG. 14 schematically shows a further embodiment of the machine, in which the second winding roller 7, the lower roller, is mounted on an oscillating arm 40 around an axis 41, thanks to a controlled motorization.

Advantageously, thanks to the solution envisaging a mobile winding roller of FIG. 14, a controlled increase of the distance between the winding rollers 6 and 7 is achieved, and it is possible to create a greater space between the two rollers for pulling together the rollers of the presser.

Therefore, such an increase in space allows to anticipate the return movement of the movable arm 32, which anticipates, in its turn, the winding phase during which the two rollers of the presser unit 30 are in contact with the coil W that is being formed and thereby extending the control of the winding process.

The present invention has been described according to preferred embodiments, but equivalent variants can be designed without departing from the agreed scope of protection.

The invention claimed is:

1. A rewinding machine comprising:

a drive unit for supplying a paper veil;

a winding unit for winding the paper veil supplied by the drive unit into a coil around a winding core, the winding unit comprising a primary roller, a secondary roller rotating in contact with the winding core, and a pressure unit comprising a pressure roller rotating on to the coil being formed;

a core exchange unit for ejecting a formed coil from the rewinding machine at an end of a winding cycle and inserting a new core to be wound;

a separation means for interrupting a continuity of the paper veil at the end of winding cycle;

a means for winding a drawing flap of the veil on the new core at a start of a new winding cycle, the pressure unit comprising at least two motorized pressure rollers arranged to alternate in position with respect to the coil and rotate simultaneously while being in contact with the coil being formed, at least during part of the winding phase, each of the at least two motorized pressure rollers having a peripheral speed that is substantially equal to a winding speed of the veil, wherein the pressure unit comprises another pressure roller to provide three pressure rollers, each of the three pressure rollers comprising a respective rotation axis integral with a common rotation axis.

2. A machine according to claim 1, wherein the at least two motorized pressure rollers rotate in contact with the coil at least during an end phase of a winding procedure.

3. A machine according to claim 1, wherein the pressure unit is positioned downstream of the winding unit in a direction of advancement of the veil.

4. A machine according to claim 1, wherein the common rotation axis is motorized independently of the pressure rollers.

5. A machine according to claim 1, wherein the common rotation axis is supported by a movable arm.

6. A machine according to claim 1, wherein the separation means is a pneumatic separation means.

7. A machine according to claim 1, wherein the separation means comprises a means for controlling a speed of the advancement of the veil at the end of each winding phase.

8. A machine according to claim 1, wherein the common rotation axis is supported by an oscillating arm movable around an axis.

9. A pressure unit for rewinding machines with a winding unit for winding a paper veil into a coil around a winding core, the pressure unit comprising:

a rotating roller putting pressure onto the coil that is being formed; and at least two motorized pressure rollers arranged to simultaneously rotate when in contact with the coil that is being formed, at least during one of the winding phases, each of the at least two motorized pressure rollers having a peripheral speed that is substantially equal to the winding speed of the veil, wherein the rotating roller and the at least two motorized pressure rollers define three pressure rollers, the three pressure rollers comprising respective rotation axes integral with a common motorized rotational axis, independently of the pressure rollers.

* * * * *